US011751629B1

(12) United States Patent
Morrison et al.

(10) Patent No.: US 11,751,629 B1
(45) Date of Patent: Sep. 12, 2023

(54) TWO-PIECE INSOLE

(71) Applicant: STABLE STEP LLC, Wadsworth, OH (US)

(72) Inventors: Joel Emery Morrison, Akron, OH (US); Luke Martin Spoerlein, Columbus, OH (US)

(73) Assignee: Stable Step LLC, Wadsworth, OH (US)

( * ) Notice: Subject to any disclaimer, the term of this patent is extended or adjusted under 35 U.S.C. 154(b) by 40 days.

(21) Appl. No.: 17/365,422

(22) Filed: Jul. 1, 2021

Related U.S. Application Data

(60) Provisional application No. 63/047,395, filed on Jul. 2, 2020.

(51) Int. Cl.
*A43B 17/00* (2006.01)
*A43B 13/38* (2006.01)
*A43B 13/12* (2006.01)

(52) U.S. Cl.
CPC ..... *A43B 17/00* (2013.01); *A43B 13/12* (2013.01); *A43B 13/386* (2013.01); *A43B 17/006* (2013.01)

(58) Field of Classification Search
CPC ..... A43B 17/00; A43B 17/006; A43B 13/386; A43B 13/12
USPC ..... 36/44
See application file for complete search history.

(56) References Cited

U.S. PATENT DOCUMENTS 844,882 A * 2/1907 Lober ..... A43B 21/37 36/36 R
1,724,349 A * 8/1929 Haag ..... A43B 21/32 36/37
2,156,511 A * 5/1939 Page ..... A43B 9/00 12/142 F
2,844,833 A * 7/1958 Odermatt ..... A43B 13/12 12/146 B
3,233,348 A * 2/1966 Gilkerson ..... A43B 7/141 36/44
4,266,350 A * 5/1981 Laux ..... A43B 7/1445 36/44
4,510,700 A * 4/1985 Brown ..... A43B 7/22 36/154
5,077,916 A * 1/1992 Beneteau ..... B29D 35/061 36/31
5,311,677 A * 5/1994 Mann ..... A43B 7/142 36/35 R
5,325,611 A * 7/1994 Dyer ..... A43B 13/12 36/27
6,038,790 A * 3/2000 Pyle ..... A43B 7/144 36/28
6,125,557 A 10/2000 Brown
6,145,220 A * 11/2000 Johnson, Jr ..... A43B 21/26 36/34 R
6,269,555 B1 8/2001 Brown
6,408,543 B1 * 6/2002 Erickson ..... A43B 7/16 36/28
6,948,263 B2 * 9/2005 Covatch ..... A43B 17/00 36/35 R (Continued)

*Primary Examiner* — Marie D Bays
(74) *Attorney, Agent, or Firm* — RENNER KENNER GREIVE BOBAK TAYLOR & WEBER

(57) ABSTRACT

An insole comprising a shell component and a chassis component. The shell component comprises support bars that define framing apertures and the chassis component comprises undercut channels that define raised pod sections.

17 Claims, 5 Drawing Sheets

(56) References Cited

U.S. PATENT DOCUMENTS

| | | | | |
|---|---|---|---|---|
| 7,124,518 | B1 | 10/2006 | Brown | |
| 7,266,908 | B2 * | 9/2007 | Issler | A43B 17/18 36/28 |
| 7,484,310 | B2 | 2/2009 | Cheskin et al. | |
| 7,484,319 | B2 * | 2/2009 | Cheskin | A43B 7/1445 36/144 |
| 7,908,768 | B2 * | 3/2011 | Cheskin | A43B 13/188 36/144 |
| 8,250,784 | B2 | 8/2012 | Cheskin et al. | |
| 8,453,346 | B2 | 6/2013 | Steszyn et al. | |
| 2002/0092202 | A1 * | 7/2002 | Masseron | A43B 13/12 36/28 |
| 2003/0140523 | A1 * | 7/2003 | Issler | A43B 13/12 36/28 |
| 2003/0150131 | A1 * | 8/2003 | McManus | A43B 7/1445 36/28 |
| 2004/0181970 | A1 * | 9/2004 | Covatch | A43B 7/1445 36/28 |
| 2005/0268491 | A1 * | 12/2005 | McDonald | A43B 13/26 36/28 |
| 2007/0033834 | A1 * | 2/2007 | Cheskin | A43B 7/223 36/28 |
| 2014/0259758 | A1 * | 9/2014 | Yeh | A43B 17/006 36/44 |
| 2016/0324264 | A1 * | 11/2016 | Johnson | A43B 3/244 |
| 2020/0093219 | A1 * | 3/2020 | Luchi | A43B 13/183 |
| 2021/0321717 | A1 * | 10/2021 | Martinez | A43B 7/144 |

* cited by examiner

TWO-PIECE INSOLE

FIELD OF THE INVENTION

The present invention generally relates to insoles for shoes and footwear and the manufacturing process to make the same. The present invention specifically relates to insoles comprising a shell component and a chassis component. The present invention more specifically relates to insoles wherein the shell component provides a structural frame that can be removably connected to the chassis component.

BACKGROUND OF THE INVENTION

Insoles can be used to accomplish a wide variety of goals for their users. Some of these goals include orthopedic correction, athletic performance improvement, comfort for the user's feet and joints, foot and joint pain relief, and arch support amongst other things. However, two of the most important attributes of insoles is in providing arch support and heel stability. Arch support and heel stability are important in helping to distribute weight and pressure across the foot which provides for improved stability, balance, support, while also lessening foot pain.

Despite insoles benefits, most users typically select their shoes and footwear more for purposes of fashion rather than for the effective cushioning properties of the pair of shoes or footwear. Thus, sometimes it is beneficial to add an insert to supplement the cushioning of the shoes and footwear on their own.

An insole with proper support and shape is typically made up of a plastic shell and a foam chassis. The shell is typically under the heel component of the foam chassis, which can somewhat reduce the cushioning effect that the foam chassis provides. Currently, the connection between the shell and chassis is through lamination, a layer of adhesive between the two components, or the two components are co-molded together. Thus, current manufacturing techniques require extra material and/or require an extra step in the manufacturing process, leading to higher production costs and making it harder to recycle the product at the termination of their life cycle.

Although insoles can greatly improve someone's wellbeing, they can initially feel awkward and be an annoyance during the first couple wears. There is a slight learning curve for the foot to adapt to the corrective treatment the insoles are providing.

There is a need for an insole that provides both cushioning and support paired with a manufacturing process that provides a simplified and cleaner connection between the shell and the chassis.

SUMMARY OF THE INVENTION

The present invention provides an insole comprising a shell component having a top surface and a bottom surface; and a chassis component having a top surface and a bottom surface, wherein the shell component comprises one or more support bars that define one or more framing apertures, wherein the chassis component comprises one or more undercut channels on the bottom surface defining one or more raised pod sections, and wherein the raised pod sections extend from the bottom surface of the chassis component through the framing apertures of the shell component.

The present invention further provides a shell component for an insole comprising support bars that define framing apertures.

The present invention further provides a chassis component for an insole comprising a top surface and a bottom surface, wherein the top surface includes a contoured footbed shape and the bottom surface includes one or more undercut channels that define one or more raised pod sections.

The present invention still further provides an insole comprising a shell component; and a chassis component; wherein the shell component comprises support bars that define framing apertures, wherein the chassis component comprises undercut channels on a bottom surface of the chassis component defining raised pod sections, and wherein the raised pod sections extend from a base on the bottom surface of the chassis component through the framing apertures, and wherein the framing apertures squeeze the base of the raised pod sections creating an interference fit.

BRIEF DESCRIPTION OF THE DRAWINGS

For a more complete understanding of the features and advantages of the present invention, reference is now made to the detailed description of the invention along with the accompanying figures in which.

DETAILED DESCRIPTION OF ILLUSTRATIVE EMBODIMENTS

An insole of the present invention is generally indicated by the numeral 10. Insole 10 generally includes a shell component 12 and a chassis component 14. Shell component 12 is the rigid component of insole 10 and it gives insole 10 its shape and provides the support for the foot of the user. Chassis component 14 is the main cushioning component of insole 10. In one or more embodiments of the present invention, shell component 12 may comprise or be formed from plastic, graphite, metal, wire, or combinations thereof in order to provide a range of flexibility, rigid support, or a combination of properties thereof.

In one or more embodiments of the present invention, chassis component 14 may comprise two or more layers. In one or more embodiments of the present invention, at least one layer of chassis component 14 may comprise or be formed from polyurethane (PU), PU blends, thermoplastic polyurethane (TPU). TPU blends, ethylene-vinyl acetate (EVA), EVA blends, or combinations thereof.

Figure 1:
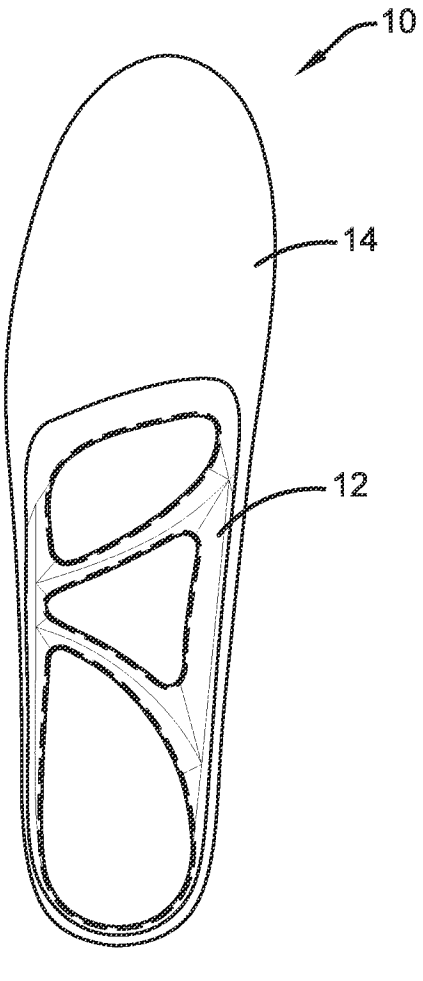
FIG. 1 is a bottom view of an insole of the present invention with a shell component secured to a chassis component.

Chassis component 14 includes a top surface and a bottom surface. Likewise, shell component 12 includes a top surface and a bottom surface. When the two-piece insole is assembled, as shown in FIG. 1, the bottom surface of chassis component 14 is adjacent to the top surface of shell component 12. As described below, the bottom surface of chassis component 14 may be removably connected to the top surface of shell component 12.

Figure 3:
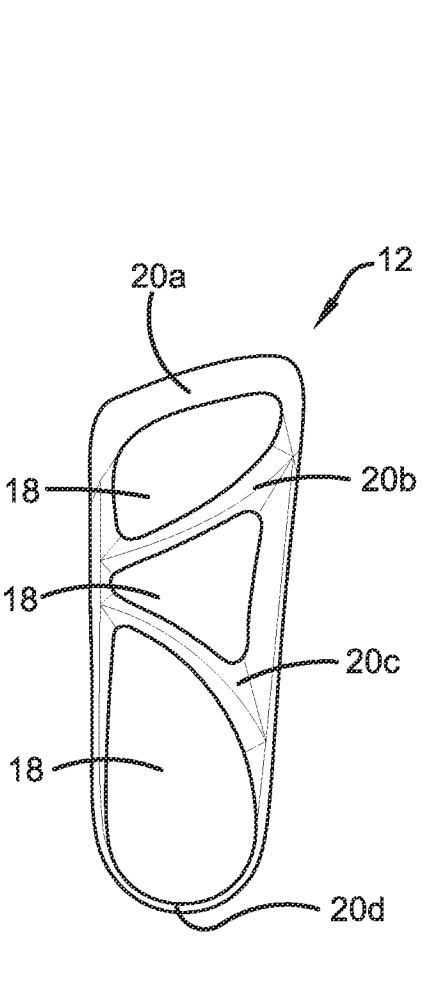
FIG. 3 is a bottom view of the shell component of FIG. 1 separate from the chassis component.
Figure 4:
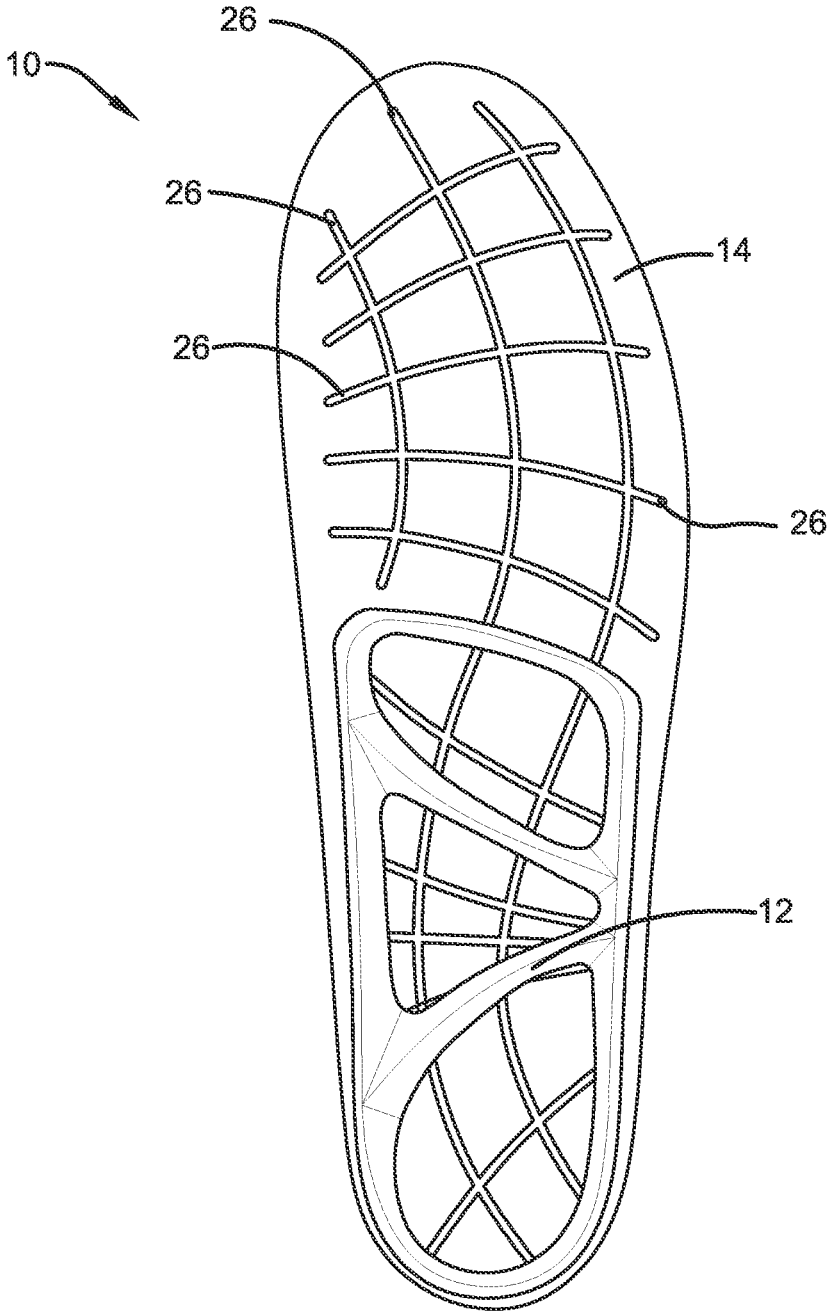
FIG. 4 is a bottom view of an insole of the present invention with a shell component secured to a chassis component having grooves on a bottom side thereof.

A shell component of a typical insole will be a molded full plastic sheet, but as can be appreciated with FIGS. 1, 3, and 4 of the present invention, shell component 12 of the present invention comprises a structural frame that includes open spaces.

The shape of shell component 12 is not particularly limited, but may be selected to provide support and/or corrective alignment for the user. In one embodiment of the present invention, shell component 12 is generally of the same overall shape as the arch and heel support component of Powerstep® insoles, which are known and proven in the scientific community to be effective at supporting and causing alignment beneficial to the wearer. In one or more embodiments, shell component 12 includes at least one framing aperture 24 of a triangular shape. In one or more embodiments, shell component 12 includes at least one framing aperture 24 of a triangular shape in an area of the shell that, when the insole is in use, corresponds to the arch area of the user's foot. However, in other embodiments of the present invention, shell component 12 may have different shapes depending on the type of support or alignment that is desired. Advantageously, shell component 12 may be configured to maintain the structural stability of the insole.

An important element of shell component 12 of the present invention is that it allows for some minimal arch flexibility which allows for the foot of a user of insole 10 to adapt to the new support more gradually as opposed to the shock of a shell component of a typical insole that can cause some discomfort to the user during initial use. Shell component 12 is defined by one or more framing apertures 18 and one or more support bars 20. The framing apertures 18 of shell component 12 may have many different shapes, including but not limited to triangle, ovals, rectangles, trapezoids, or a combination thereof. The framing apertures 18 of shell component 12 are surrounded by a plurality of support bars. In the embodiment that is shown in the figures, the support bars are shown as 20*a*, 20*b*, 20*c*, and 20*d*. It is the number and positioning of the support bars 20*a*, 20*b*, 20*c*, and 20*d* that define the framing apertures 18. Furthermore, as will be discussed in more detail, the support bars 20*a*, 20*b*, 20*c*, and 20*d* match and fit securely into undercut channels 22*a*, 22*b*, 22*c*, and 22*d* on a bottom surface 16 of chassis component 14. In one or more embodiments, the shell may include additional support bars 20.

In one or more embodiments, the shell component 12 has beveled edges. In one or more embodiments, the outer edges of shell component 12 are beveled. In one or more embodiments, the edges of support bars 20 are beveled edges. In one or more embodiments, the outer edges of shell component 12 and the edges of support bars 20 are beveled.

Chassis component 14 has a top surface 15 and a bottom surface 16. Top surface 15 of chassis component 14 may have a contoured footbed shape, for example, one that mimics the known architecture of the Powerstep® insoles or other similar insoles. In one or more embodiments of the present invention, chassis component 14 includes a cloth layer that provides the top surface 15 and a foam layer that provides the bottom surface 16. For purposes of this specification, "cloth" should be interpreted broadly to include woven or felted fabric made from fibers or other material. In one or more embodiments, the foam layer may comprise polyurethane, a polyurethane blend, thermoplastic polyurethane, a thermoplastic polyurethane blend, ethylene-vinyl acetate, an ethylene-vinyl acetate blend, or a combination thereof. In one or more embodiments, the foam layer may comprise an inhomogeneous blend of polymer domains within a matrix. In one or more embodiments, the bottom surface 16 of the chassis component is textured or bumpy.

Figure 2:
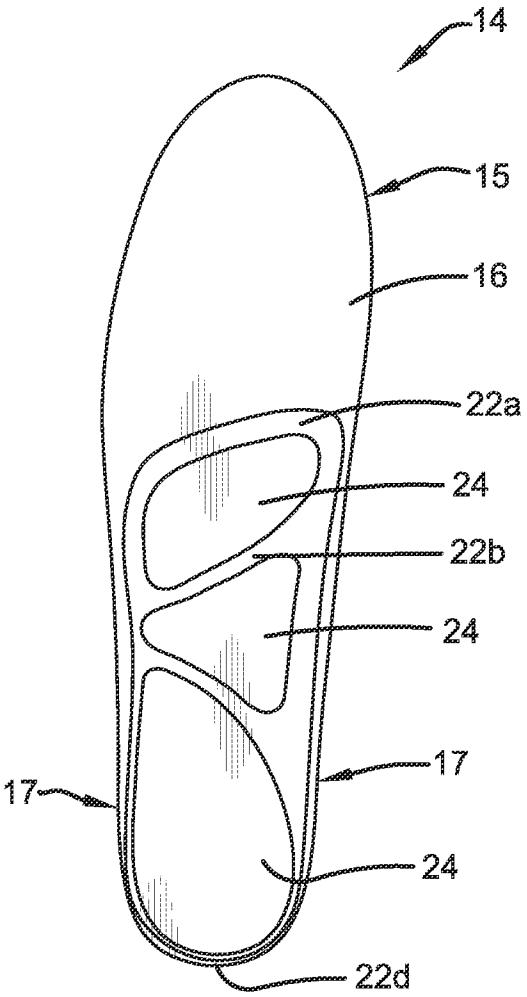
FIG. 2 is a bottom plan view of the chassis component of the insole of FIG. 1 separate from the shell component.

FIG. 2 showcases chassis component 14 separate from shell component 12, so that bottom surface 16 may be seen. Bottom surface 16 includes a plurality of undercut channels 22, with the number, shape, dimensions and positions of the undercut channels 22 mimicking the number, shape, dimensions and positions of the support bars 20 of shell component 12. Chassis component 14 also contains one or more raised pod sections 24. The number, dimensions and positions of the raised pod sections 24 correspond to the number, dimensions, and positions of framing apertures 18 of shell component 12. Therefore, as shown in FIGS. 1 and 4, when the shell component 12 and the chassis component 14 are assembled, the support bars 20 of shell component 12 align with the undercut channels 22 of chassis component 14 and the raised pod sections 24 of chassis component 14 will securely fit into the framing apertures 18 of shell component 12.

In one or more embodiments of the present invention, shell component 12 is removably secured to the chassis component 14 by a friction fit without the use of an adhesive or glue or without the aid of any other bonding mechanism such as co-molding or lamination.

As shown in FIG. 2, undercut channels 22 may be located on the bottom surface 16 of the chassis component 14 and/or along side edges 17 of chassis component 14. Connecting chassis component 14 and shell component 12 at the bottom surface 16 and at the side edges 17 of chassis component 14 provides tensions in both the vertical and horizontal axes, allowing for a stronger and more secure fit of shell component 12 to chassis component 14. In one or more embodiments, undercut 22*d* extends up and around the heel area of chassis component 14, such that no portion of shell component 12 is positioned under the heel strike area. Advantageously, a two-piece insole having no part of shell component 12 under a heel strike area of a user's foot provides increased overall cushioning sensations.

In one embodiment of the present invention, such as shown in FIG. 4, chassis component 14 of insole 10 includes one or a plurality of grooves 26 on the bottom surface 16. Grooves 26 can be present across the entirety of bottom surface 16, or they can be placed in specific sections of chassis component 14, such as at the areas of chassis component 14 that align with the heel and ball portions of a user's foot. Grooves 26 allow extra room for material displacement when the insole is in use. This additional room for material displacement creates a more "molded to shape" feel for each user's unique foot shape. In one or more embodiments, the bottom surface of chassis component 14 may be smooth, and in other embodiments, the bottom surface may be textured and/or bumpy.

Advantageously, lamination of the shell and chassis is not required. In one embodiment of the present invention, insole 10 can be constructed without the need for any adhesive between the shell 12 and chassis 14. Due, at least in part, to the design and arrangement of the support bars 20 of the shell component and the undercut configuration of the channels 22 in the bottom side of the chassis component, the components are snugly, and yet releasably, connected by means of a friction fit. In other embodiments of the present invention, a minor amount of adhesive can additionally be used between the shell 12 and chassis 14. The term "minor amount" is meant to define an amount of minor that is smaller than typically used to attach a shell component to a chassis component in insoles of the prior art. Advantageously, the amount and type of adhesive may be selected to allow for shell 12 and chassis 14 to be separated with ease.

With this new construction method of securing a shell component 12 to a chassis component 14 as described above, insole 10 has the unique ability for more customization and extended product lifecycle. The attachment method between shell component 12 and chassis component 14 allows for the user to physically remove the shell component 12 from the chassis component 14 and apply the shell component 12 to a different chassis component 14. This ease of use creates a unique opportunity. Chassis components 14 comprising different materials can be provided, wherein the material can be selected to offer distinct benefits for the user. For instance, chassis components 14 may comprise material that is selected from, but not limited to, energy return foam, slow recovery foam, or foam with a technical top cover fabric. Many different chassis component 14 options are possible for use with the shell component 12. The user can select a certain chassis component 14 that will provide the type of cushioning and support that is tailored to their needs for a particular activity or day. In addition, shell component 12 can be built with differing materials and differing shapes that offer different benefits for the user. For instance, shell components 12 can be made having different arch heights and each shell component 12 having a different arch height can be interchangeably secured to the same chassis component 14.

Moreover, individual components can be replaced as they become worn. Generally, chassis component 14 may be expected to have a shortened lifecycle compared to its shell component 12 counterpart. For example, some of the cushioning effect of the chassis component 14 may be lost over time due to compression set. A user may choose to replace only the chassis component 14, extending the lifetime of insole 10, and improving the sustainability of the product.

Figure 5:
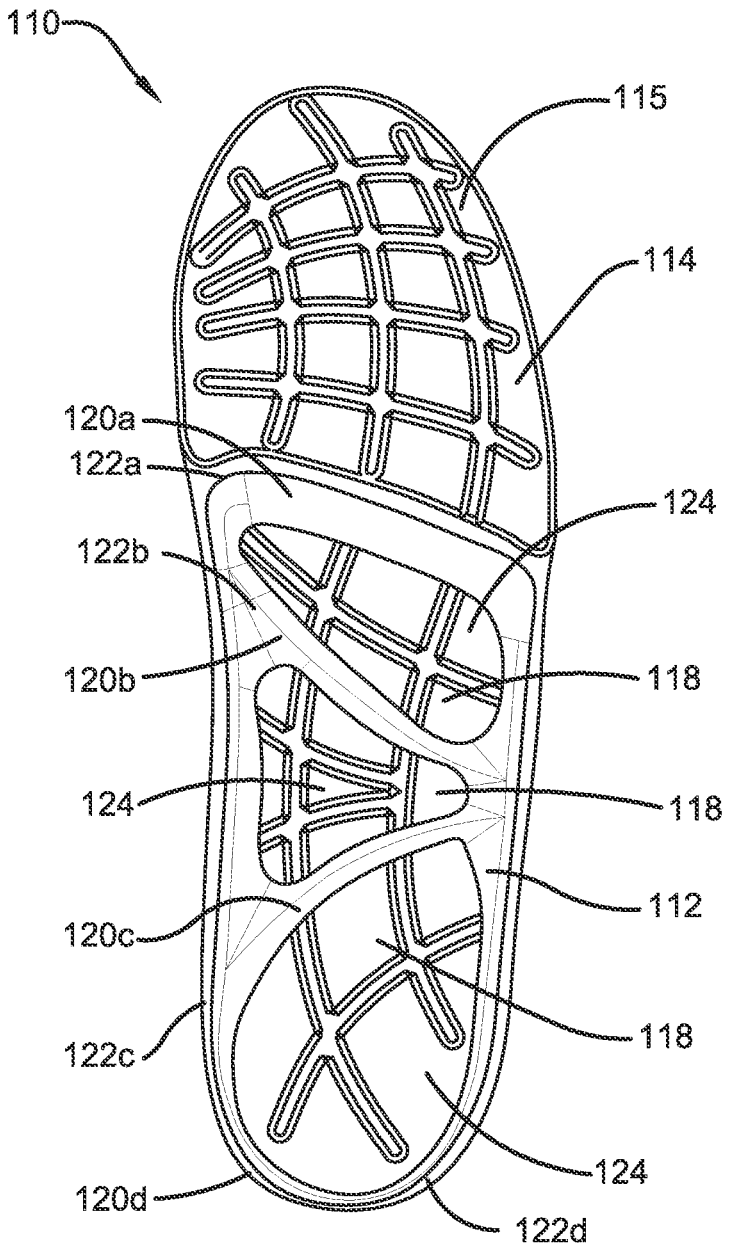
FIG. 5 is a bottom view of one embodiment of an insole of the present invention with a shell component secured to a chassis component.
Figure 7:
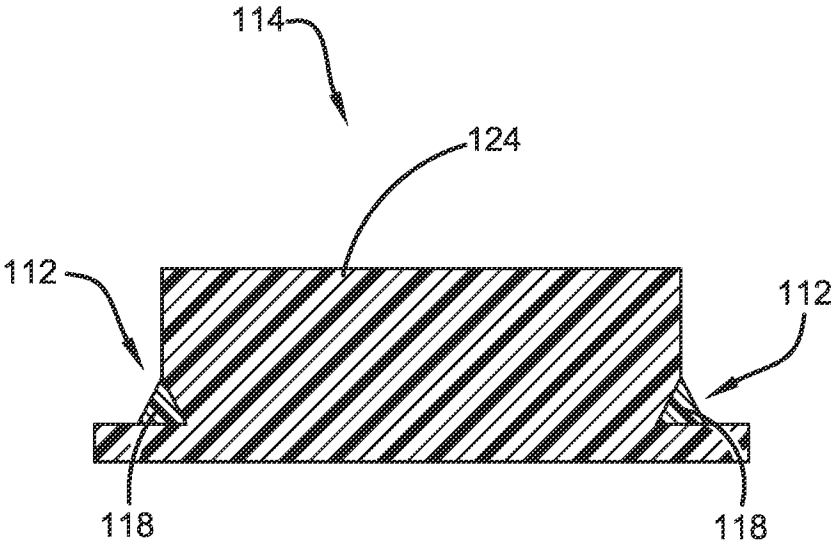
FIG. 7 is an orthogonal view of the single raised pod section of FIG. 6 with a framing aperture of the shell component of FIG. 5 squeezing said raised pod section.
Figure 6:
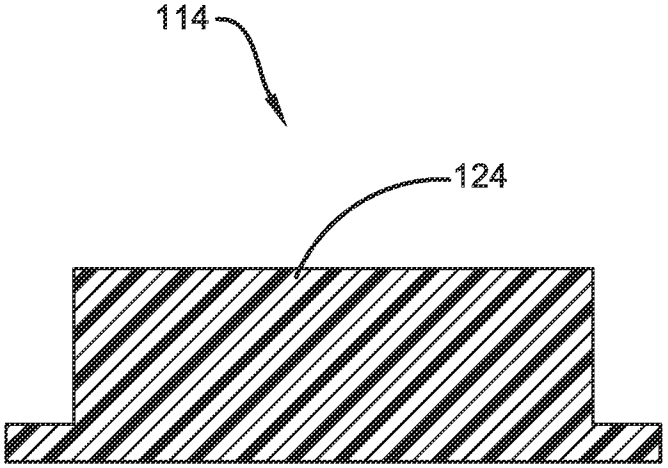
FIG. 6 is an orthogonal view of a single raised pod section of the insole of FIG. 5.

In one embodiment of the present invention, as shown in FIGS. 5-7, it is contemplated that an insole 110 includes a chassis component 114 secured to a shell component 112 through an interference fit. While insole 110 may include a plurality of undercut channels 122 on the bottom surface 115 of chassis component 114, the undercuts 122 may not be as deep or well defined as the undercut channels 22 in insole 10. Insole 110 includes one or more raised pod sections 124 of chassis component 114. Raised pod sections 124 may be slightly larger than the framing apertures 118 of the shell component 112, such when shell component 112 is secured to chassis component 114, framing apertures 118 push and squeeze around the base of raised pod sections 124 as shown in FIG. 7, holding them in place. FIG. 6 shows an individual pod section 124 that has not been pushed and squeezed through a framing aperture 118, and FIG. 7 shows an individual pod section 124 that has been pushed through a framing aperture 118, such that the framing aperture 118 squeezes the base of the pod section 124. This relationship between the framing apertures 118 and the raised pod section 124 creates an interference fit between the chassis component 114 and the shell component 112.

Figure 10:
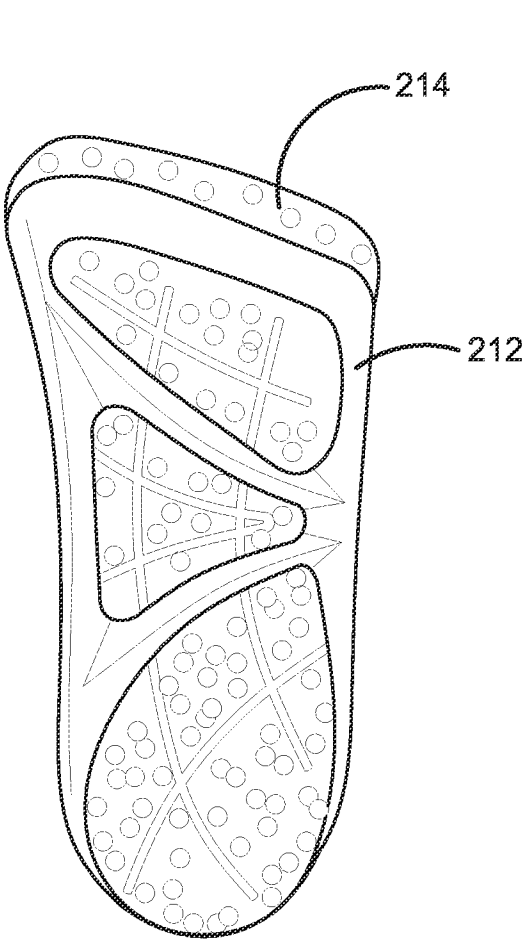
FIG. 10 is a bottom view of the insole of FIG. 9.
Figure 9:
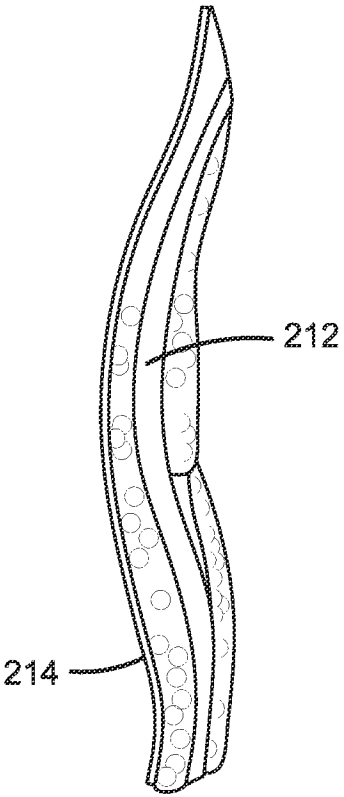
FIG. 9 is an elevational side view from the left (inside) of an insole that is adapted for use with a left foot of a user.
Figure 8:
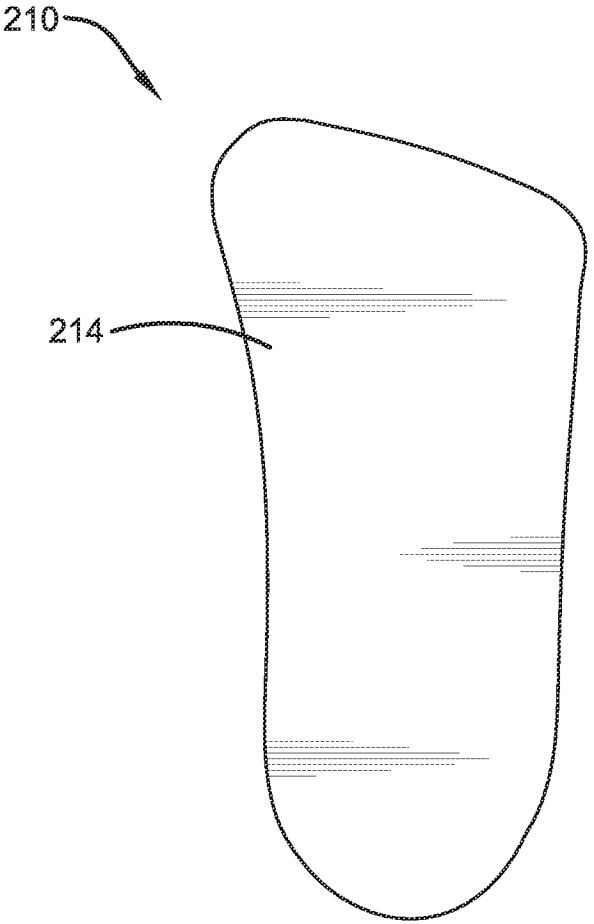
FIG. 8 is a top plan view of an insole of the present invention that is adapted for use with a right foot of a user.

A two-piece insole of the present invention is shown in FIGS. 8-10, wherein chassis component 214 is assembled with shell component 212 to form two-piece insole 210.

In light of the foregoing, it should be appreciated that the present invention significantly advances the art by providing a two-piece insole that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. An insole comprising: a shell component that is removably connected to a chassis component, said shell component having a top surface and a bottom surface; and said chassis component having a top surface and a bottom surface, wherein the shell component comprises one or more support bars that define one or more framing apertures, wherein the chassis component comprises one or more undercut channels in the bottom surface defining one or more raised pod sections, and wherein the raised pod sections extend from the bottom surface of the chassis component through the framing apertures of the shell component such that the support bars fit in the undercut channels to removable connect the shell component to the chassis component.

2. The insole of claim 1, wherein the raised pod sections extend from a base on the bottom surface of the chassis component through the framing apertures, wherein the raised pod sections have dimensions that are slightly larger than the framing apertures, and wherein the framing apertures squeeze the base of the raised pod sections creating an interference fit.

3. The insole of claim 1, wherein the support bars of the shell component lock into place within the undercuts of the chassis component by means of a friction fit.

4. The insole of claim 1, wherein the shell component includes at least three framing apertures.

5. The insole of claim 1, wherein the chassis component includes two or more layers, wherein the two or more layers include a cloth layer that forms the top surface of the chassis component a foam layer that forms the bottom surface of the chassis component.

6. A shell component for an insole having an arch area and a heel area, said shell component comprising support bars that define framing apertures wherein at least one framing aperture is triangular and is located in the arch area and extends under a medial longitudinal arch of the arch area.

7. The shell component of claim 6, wherein the shell component includes at least three framing apertures.

8. The shell component of claim 6, wherein the shell component has outer edges that define the shape of the shell component and inner edges that define the shape of the support bars and framing apertures, and wherein at least some of the outer edges and inner edges are beveled.

9. The shell component of claim 6, wherein the shell component comprises plastic, graphite, metal, wire, or a combination thereof.

10. The shell component as in claim 6, wherein at least one framing aperture has a lateral vertex at a lateral longitudinal arch of the arch area, and widens from the lateral vertex to two opposed medial vertices at the medial longitudinal arch.

11. An insole as in claim 1, wherein the chassis component and the one or more raised pod sections are of unitary construction.

12. A chassis component for an insole comprising a top surface and a bottom surface, wherein the top surface includes a contoured footbed shape and one or more undercut channels in the bottom surface that define one or more raised pod sections, the undercut channels adapted to removably receive support bars of a shell component to create an insole.

13. The chassis component of claim 12, wherein the chassis component includes at least one raised pod section having a triangular shape.

14. The chassis component of claim 12, wherein the chassis component includes at least three raised pod sections.

15. The chassis component of claim 12, wherein the chassis component includes one or a plurality of grooves on the bottom surface.

16. The chassis component of claim 12, wherein the chassis component comprises polyurethane, a polyurethane blend, thermoplastic polyurethane, a thermoplastic polyurethane blend, ethylene-vinyl acetate, an ethylene-vinyl acetate blend, or a combination thereof.

17. An insole comprising:

a shell component that is removably connected to a chassis component; wherein the shell component comprises support bars that define framing apertures, wherein the chassis component comprises undercut channels in a bottom surface of the chassis component defining raised pod sections, and wherein the raised pod sections extend from a base on the bottom surface of the chassis component through the framing apertures such that the support bars fit in the undercut channels to removable connect the shell component to the chassis component, and the framing apertures squeeze the base of the raised pod sections creating an interference fit and overcoming the interference fit separates the shell component form the chassis component.

* * * * *